US008413839B2

(12) United States Patent
Horvath

(10) Patent No.: US 8,413,839 B2
(45) Date of Patent: Apr. 9, 2013

(54) CARRYING AIDS FOR CONTAINERS

(76) Inventor: Dwayne A. Horvath, Pittstown, NJ (US)

( * ) Notice: Subject to any disclaimer, the term of this patent is extended or adjusted under 35 U.S.C. 154(b) by 243 days.

(21) Appl. No.: 12/839,146

(22) Filed: Jul. 19, 2010

(65) Prior Publication Data

US 2012/0012601 A1 Jan. 19, 2012

(51) Int. Cl.
*B65D 25/32* (2006.01)
*B65D 25/28* (2006.01)

(52) U.S. Cl. ..... 220/755; 16/421; 220/760; 220/776

(58) Field of Classification Search ..... 220/755, 220/760, 776; 16/421
See application file for complete search history.

(56) References Cited

U.S. PATENT DOCUMENTS

| | | | | |
|---|---|---|---|---|
| 496,521 | A | 5/1893 | Low | |
| 700,799 | A | 5/1902 | Mullan | |
| 969,528 | A | 9/1910 | Disbrow | |
| 1,157,475 | A | 10/1915 | Webster | |
| 1,268,775 | A * | 6/1918 | Stanger | 294/171 |
| 1,468,848 | A | 9/1923 | Wear | |
| 1,599,222 | A * | 9/1926 | Engelman | 220/755 |
| 1,678,005 | A * | 7/1928 | Hallerman | 294/171 |
| 1,781,583 | A * | 11/1930 | Hodgson | 220/755 |
| 2,026,536 | A * | 1/1936 | Hothersall | 220/755 |
| 2,231,830 | A | 2/1941 | Moore et al. | |
| 2,278,610 | A | 4/1942 | Brownson et al. | |
| 2,287,329 | A | 6/1942 | Santa Maria et al. | |
| 2,294,197 | A | 8/1942 | Moore et al. | |
| D152,157 | S | 12/1948 | Jones | |
| D159,141 | S | 6/1950 | Conrad | |
| 2,684,797 | A | 7/1954 | Schulte | |
| 2,765,969 | A | 10/1956 | Bennington | |
| 3,679,103 | A | 7/1972 | Chmela et al. | |
| 3,682,352 | A | 8/1972 | Doucette | |
| 3,992,021 | A | 11/1976 | Tobin | |
| 4,527,720 | A | 7/1985 | Hayes | |
| 4,627,546 | A | 12/1986 | Carranza | |
| 4,660,875 | A | 4/1987 | Ziegler | |
| 4,813,458 | A | 3/1989 | Jacobucci | |
| 4,823,433 | A | 4/1989 | Curtis | |
| 4,927,046 | A | 5/1990 | Armstrong | |
| 5,092,481 | A | 3/1992 | Skelton | |
| 5,251,781 | A | 10/1993 | Skelton | |
| 5,455,981 | A | 10/1995 | Wiese | |
| 5,471,698 | A | 12/1995 | Francis et al. | |
| 5,471,700 | A | 12/1995 | Pereira | |
| 5,482,339 | A | 1/1996 | Chishko, Jr. | |
| 5,566,391 | A | 10/1996 | Williamson | |
| 5,570,807 | A | 11/1996 | Busch | |
| 5,606,772 | A * | 3/1997 | Ilic | 16/421 |

(Continued)

*Primary Examiner* — Mickey Yu
*Assistant Examiner* — Niki Eloshway
(74) *Attorney, Agent, or Firm* — Kolisch Hartwell, PC

(57) ABSTRACT

Carrying aids may be used with containers that include a wire bail pivotably attached to the container. The carrying aids may include a body configured to engage the bail and be grasped by a grasping hand to suspend the container in a first position. The body may be configured to transfer a torque from a grasping hand to the bail. The torque may pivot the bail relative to the container while lifting the container relative to a grasping hand from the first position to a second position above the first position. In some examples, the bail, with the body mounted thereon, may be pivoted down proximate the sidewall of the container such that the body engages a thumb of a grasping hand and presses the hand against the sidewall to stabilize and support the container relative to the grasping hand.

29 Claims, 7 Drawing Sheets

U.S. PATENT DOCUMENTS

| | | | | |
|---|---|---|---|---|
| 5,806,709 | A | 9/1998 | Marshall, II | |
| 5,832,563 | A | 11/1998 | Simpson | |
| 5,836,469 | A | 11/1998 | Zebrowski | |
| 5,849,021 | A | 12/1998 | DiFrancesco et al. | |
| 5,947,011 | A | 9/1999 | Xu | |
| 6,135,310 | A * | 10/2000 | Svehaug | 220/700 |
| D460,845 | S | 7/2002 | Bergman | |
| 6,708,838 | B2 | 3/2004 | Bergman et al. | |
| 6,851,571 | B1 | 2/2005 | LaLonde | |
| 6,863,191 | B2 | 3/2005 | Kesling | |
| 6,865,748 | B2 | 3/2005 | Young | |
| 7,644,835 | B2 | 1/2010 | Bergman | |
| 7,673,770 | B2 * | 3/2010 | Summerfield | 220/755 |
| 7,805,813 | B1 * | 10/2010 | Bunyard | 16/425 |
| 2002/0145001 | A1 * | 10/2002 | Morelock | 220/755 |
| 2004/0173627 | A1 * | 9/2004 | Kesling | 220/756 |
| 2006/0102638 | A1 * | 5/2006 | Summerfield | 220/755 |

* cited by examiner

Fig. 1
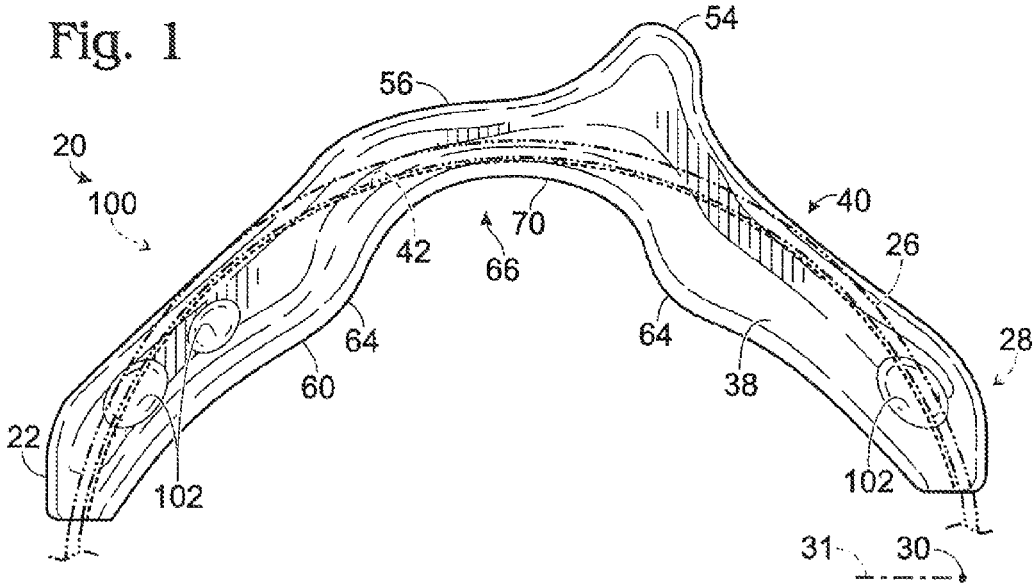
Fig. 2
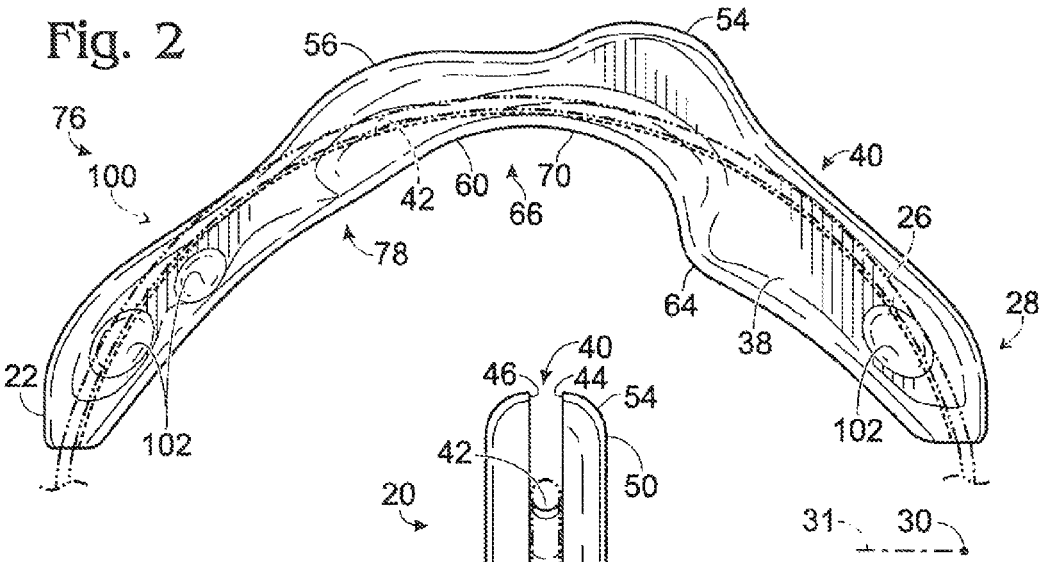
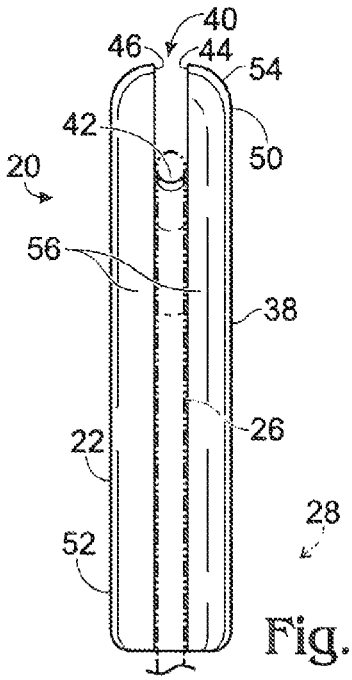
Fig. 4

Fig. 11
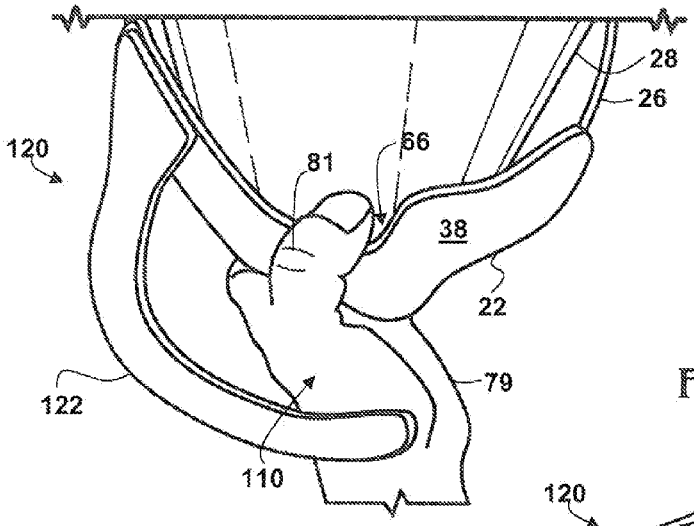
Fig. 12
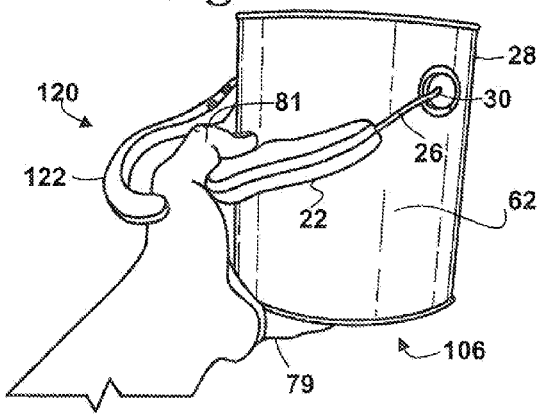
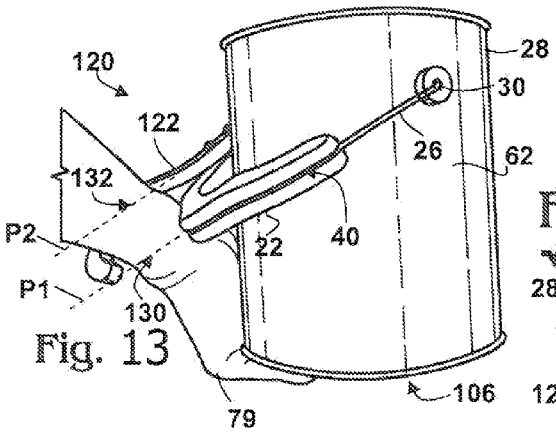
Fig. 13
Fig. 14
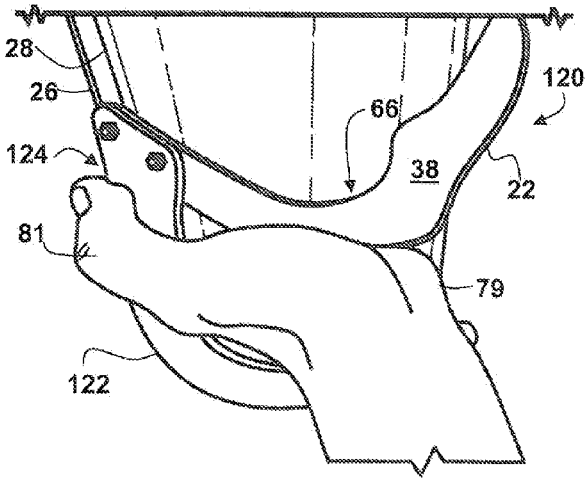

38

CARRYING AIDS FOR CONTAINERS

BACKGROUND

Examples of carrying aids for containers are disclosed in U.S. Pat. No. 6,708,838; U.S. Pat. No. 5,092,481; U.S. Pat. No. 4,823,433; U.S. Pat. No. 4,527,720; U.S. Pat. No. 3,679,103; and U.S. Pat. No. 2,294,197. Examples of carrying aids with auxiliary braces are disclosed in U.S. Pat. No. 4,660,875; U.S. Pat. No. 4,813,458; U.S. Pat. No. 5,455,981; U.S. Pat. No. 5,471,698; U.S. Pat. No. 5,471,700; and U.S. Pat. No. 5,832,563. The disclosures of these and all other publications referenced herein are incorporated by reference in their entirety for all purposes.

SUMMARY

In some examples, carrying aids may be used with containers that include a curved wire bail pivotably attached to at least one pivot point on the container. Such carrying aids may include an elongate body configured to engage the bail. The elongate body may be configured to be grasped by a grasping hand to suspend the container from a grasping hand in a first position. The elongate body may be configured to transfer a torque from a grasping hand to the bail. The torque may tend to pivot the bail about the at least one pivot point while lifting the container relative to a grasping hand from the first position to a second position above the first position.

In some examples, carrying aids may be used with containers that include a sidewall and a curved wire bail pivotably attached to the container for rotation of the wire bail about an axis. Such carrying aids may include an elongate body configured to be mounted on and extend along the bail to stabilize and support the container relative to a grasping hand. The elongate body may include a bearing surface configured to engage and rest against a thumb of a grasping hand when at least a portion of the palm of a grasping hand is engaged with the sidewall of the container and the bail is pivoted about the axis such that the bearing surface is proximate the sidewall of the container. The bearing surface may include a projection that extends toward the axis when the elongate body is mounted on the bail. The projection may be configured to engage a thumb of a grasping hand. The bearing surface may urge a grasping hand against the sidewall of the container when the container's weight causes the bail to rotate about the axis.

In some examples, carrying aids may be configured as paint can holders, which may include a body configured to be mounted on a bail of a one-gallon paint can. Such paint can holders may be configured to be grasped by a user's grasping hand to support the paint can by the bail. The body may include opposed leverage surfaces configured to engage a thumb and forefinger of a grasping hand as a user grasps the body with a grasping hand. The opposed leverage surfaces may be configured to permit a user to selectively apply a torque to and pivot the bail using a thumb and forefinger of a grasping hand such that the bail is displaced to one side.

In some examples, carrying aids may be configured with an auxiliary leverage brace. The leverage brace may bear against the back (dorsum) of the grasping hand, wrist, or forearm of a user to increase the mechanical advantage in leveraging a grasping hand against the arc of the bail, for better load distribution, more comfortable use, and more secure grip. The leverage brace may also function as a hook for hanging a paint can by the bail.

BRIEF DESCRIPTION OF DRAWINGS

FIG. 1 is a front view of a nonexclusive illustrative example of a carrying aid.

FIG. 2 is a front view of another nonexclusive illustrative example of a carrying aid.

FIG. 4 is a side view of the carrying aid of FIG. 1.

FIG. 9 is a side perspective view of a carrying aid with an auxiliary leverage brace, being used to support a paint can with a hand position similar to that shown in FIG. 8, but with a left human hand.

FIG. 10 is a side perspective view of the carrying aid of FIG. 9, with a forearm hooked through the auxiliary leverage brace to help support a paint can, with the leverage brace contacting a hand at a dorsal surface below a wrist.

FIGS. 11-14 show different views of the illustrative example of a carrying aid of FIGS. 9 and 10, shown engaged with the bail of a one-gallon paint can in an opposite orientation from that of FIGS. 9 and 10.

FIG. 11 is a side perspective view of a carrying aid with an auxiliary leverage brace, being used to support a paint can with a hand position similar to that shown in FIG. 9, but viewed more from a top of the paint can.

FIG. 12 is a side perspective view of the carrying aid shown in FIG. 9, but viewed more from a side of the paint can.

FIG. 13 is a side perspective view of the carrying aid of FIG. 12, with a forearm hooked through the auxiliary leverage brace to help support a paint can with a hand position similar to that shown in FIG. 10, but with the leverage brace contacting the forearm above a wrist.

FIG. 14 is a side perspective view of the carrying aid of FIG. 11, with a back of a hand hooked through the auxiliary leverage brace to help support a paint can.

DETAILED DESCRIPTION

Figure 3:
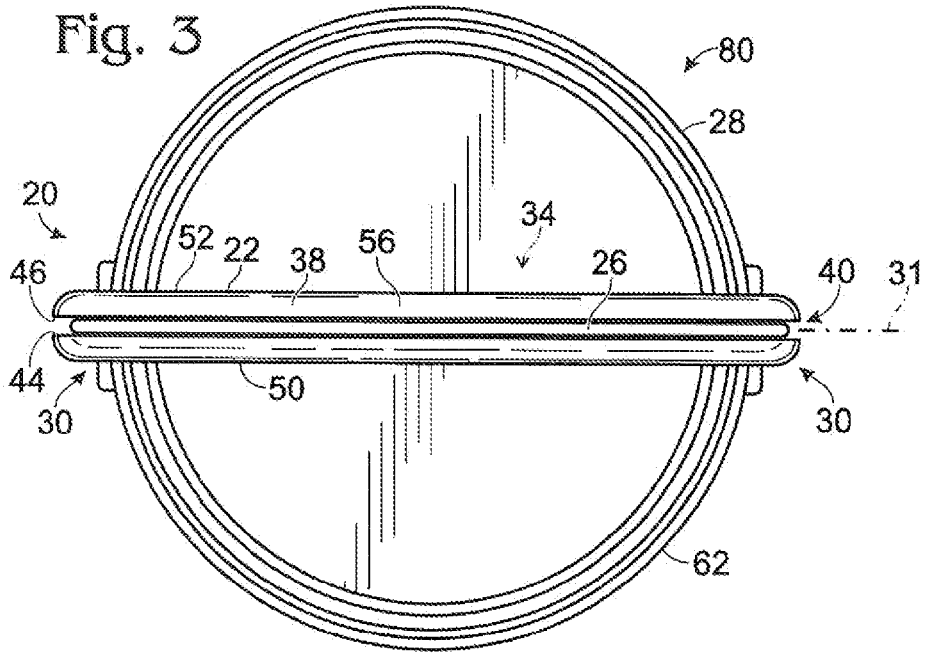
FIG. 3 is top view showing the carrying aid of FIG. 1, shown engaged with the bail of a one-gallon paint can, with the bail positioned above the container as would be the case when the container is carried by the bail in the conventional manner.

A nonexclusive illustrative example of a carrying aid for use with a container is shown generally at 20 in FIGS. 1 and 3-6. Unless otherwise specified, the carrying aid 20 may, but is not required to, contain at least one of the structures, components, functionalities, concepts, and/or variations described, illustrated, and/or incorporated herein. As shown and suggested in FIG. 1, the carrying aid 20 may include an elongate body 22 configured to engage and be mounted on the bail 26 of a container 28.

The bail 26 may be pivotably attached to at least one pivot point 30 on the container 28 to permit pivoting or rotation of the bail 26 about an axis 31. As shown and suggested in the examples of FIGS. 3 and 5-7, carrying aids may be configured for use with bails 26 that are formed from a curved wire that is pivotably attached to opposed pivot points 30 on the container to permit pivoting or rotation of the wire bail about the axis 31.

Figure 5:
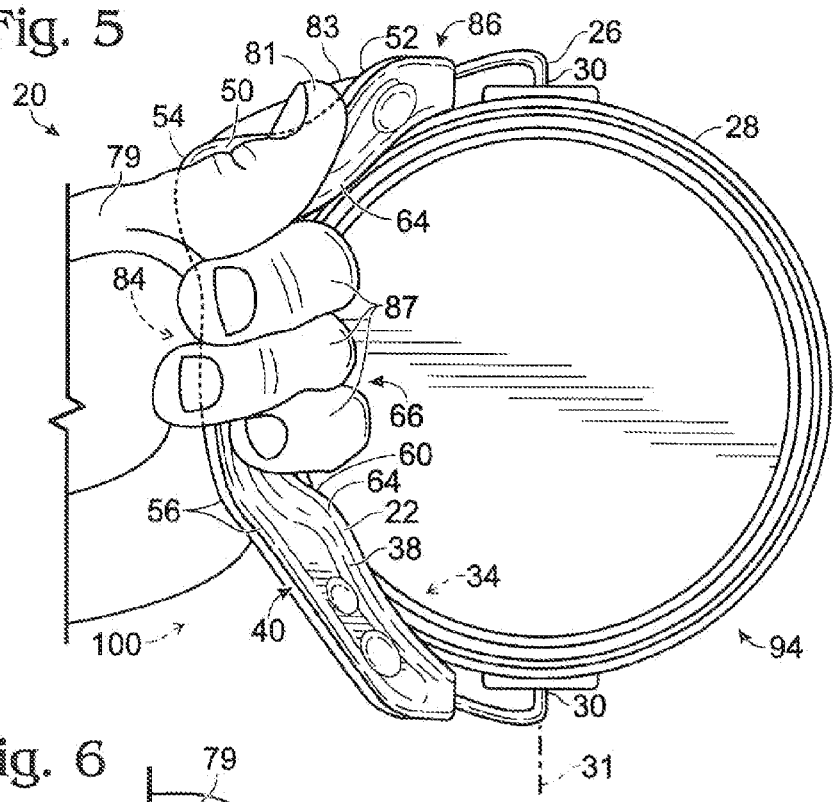
FIG. 5 is a top view of the carrying aid FIG. 1, shown engaged with the bail of a one-gallon paint can and being used to support the paint can.
Figure 6:
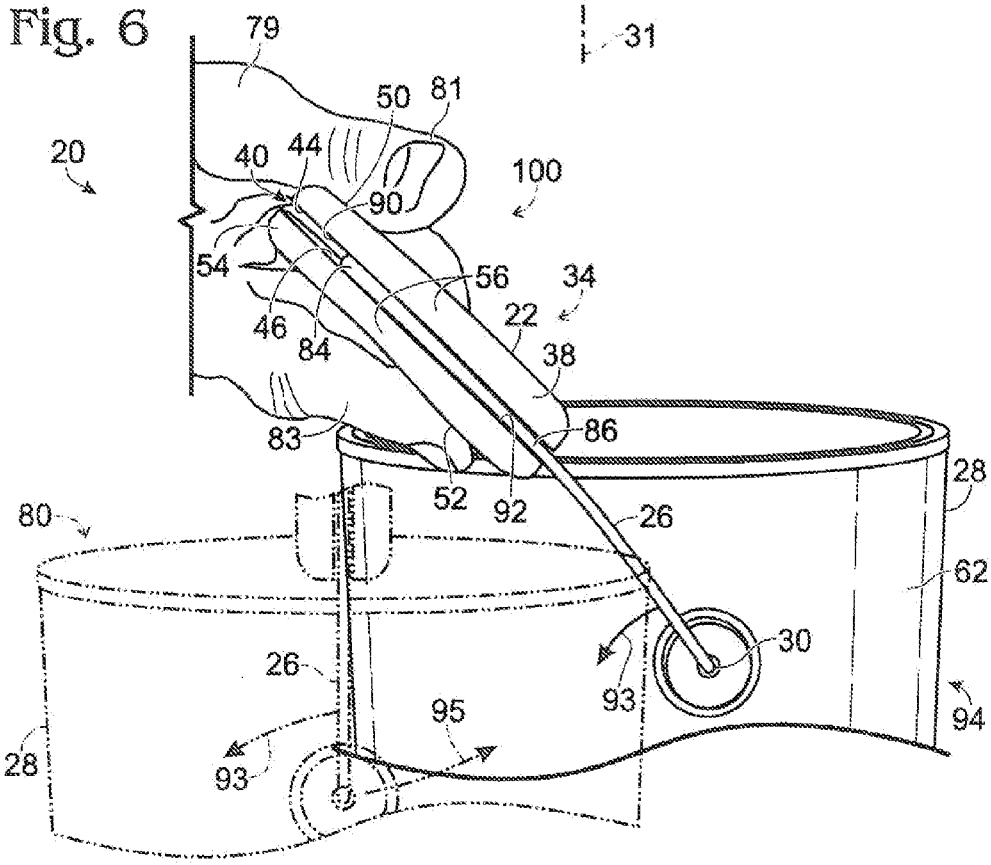
FIG. 6 is a side view of the carrying aid and paint can of FIG. 5.

Although the carrying aid 20 may be used with any container 28 having a suitable bail, some examples of carrying aids may be configured as paint can holders, as generally shown in FIGS. 3, 5 and 6, where the illustrated containers are one-gallon paint cans. In such examples, the elongate body may include at least one structure, feature or holder 34 configured to engage and retain a paint brush. Nonexclusive illustrative examples of suitable holders for a paint brush may include mechanical clamps, magnetic elements, or the like.

As generally shown in FIGS. 1, 3 and 4, the elongate body 22 may include an exterior surface 38 and a groove 40 configured to receive and engage the bail 26. The groove 40 may include a base surface 42 and first and second opposed sidewalls 44, 46 that extend from the base surface of groove 40 to the exterior surface of the elongate body. In some examples, such as when the elongate body 22 is configured for use with a curved wire bail 26, as shown in FIGS. 1 and 2, the base surface 42 of the groove 40 may be curved to engage the bail. As shown in FIGS. 3 and 4, the first and second opposed sidewalls 44, 46 of the groove 40 may be substantially flat in some examples of the elongate body 22.

As generally shown in FIGS. 3 and 4, the exterior surface 38 of the elongate body 22 may include first and second opposed leverage or grip surfaces 50, 52. The first and second opposed grip surfaces 50, 52 may be configured to engage a thumb and forefinger of a grasping hand as a user grasps the elongate body 22 with a grasping hand, as will be more fully discussed below.

It should be understood that the body 22 may be reversible, such that a user may selectively and/or interchangeably grasp the body with either of a user's right- or left-hands. Furthermore, a user may grasp the body 22 with either of the first and second opposed grip surfaces 50, 52 proximate the palm of whichever of a user's hands a user is grasping the body. Accordingly, the identification herein of particular ones of the opposed grip surfaces as the first and second ones of the opposed grip surfaces 50, 52 is made with reference to the particular examples, grips and uses illustrated in the drawings. Thus, either of the opposed grip surfaces may be the first or second one of the opposed grip surfaces, depending on a particular situation.

In some examples, the elongate body 22 may include a projection 54 that extends generally away from the axis 31 and the at least one pivot point 30 when the elongate body is engaged with the bail 26 of a container 28. As will be more fully discussed below, at least a portion of at least one of the first and second opposed grip surfaces 50, 52 may be disposed on the projection 54. As shown in the examples of FIGS. 1 and 2, the projection 54 may be asymmetrically disposed on the elongate body 22, such that the projection is displaced toward one end of the elongate body. However, in other examples, the projection 54 may be symmetric with respect to the elongate body, such as where the projection is centered between the ends of the body.

As shown in FIG. 4, some examples of the elongate body 22 may include a contoured or rounded exterior portion 56. The rounded exterior portion 56 may be configured to engage the palm of a grasping hand when a user is holding the elongate body in the grasping hand.

Figure 7:
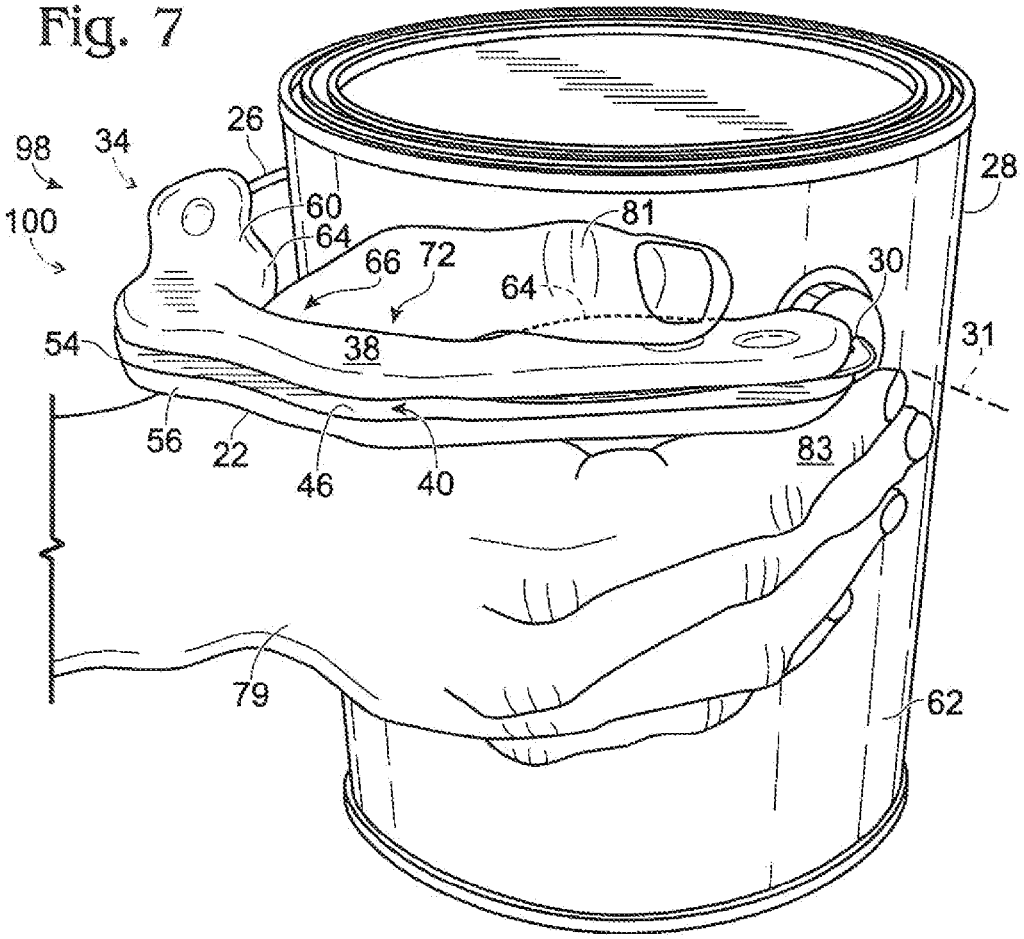
FIG. 7 is a side perspective view of a carrying aid, shown engaged with the bail of a one-gallon paint can and being used to support the paint can.

As shown in the examples of FIGS. 1 and 2, the elongate body 22 may include a curved grasping or bearing surface 60, which is generally oriented toward the axis 31 when the elongate body is engaged with the bail 26. The curved bearing surface 60 may be configured to permit the bail 26, with the elongate body 22 mounted thereon, to be pivoted down proximate a sidewall 62 of the container when the elongate body is mounted on the bail, as is generally shown in FIG. 7.

In some examples, the bearing surface 60 may include a projection 64 that generally extends toward the axis 31 when the elongate body 22 is mounted on the bail 26. As shown in the example of FIG. 1, the bearing surface 60 may include a pair of projections 64, which may be symmetric with respect to each other, that collectively define the ends of a recess 66 on the bearing surface.

When one or more projections 64 are present on the bearing surface 60, contact between the projection or projections and the sidewall 62 of the container 28 may establish a pivotable end point of the bail 26 about the axis 31. In particular, the projection may limit the extent to which the bail may be rotated toward the sidewalls of the container. When a projection 64 establishes a pivotable end point of the bail 26 about the axis 31, a portion 70 of the bearing surface within the recess 66 may be spaced from the sidewall of the container when the bail is at the pivotable end point such as to maintain an opening 72 between the portion 70 of the bearing surface and the sidewall 62 of the container, as generally suggested in FIG. 7.

Another nonexclusive illustrative example of a carrying aid for a container is shown generally at 76 in FIG. 2. Unless otherwise specified, the carrying aid may, but is not required to, contain at least one of the structures, components, functionalities, concepts, and/or variations described, illustrated, and/or incorporated herein.

In the example shown in FIG. 2, the bearing surface 60 of the elongate body 22 includes a single projection 64, which may define one end of the recess 66, with the end 78 of the recess 66 opposite the projection 64 transitioning or blending relatively smoothly into the remainder of the bearing surface 60. The differences between the carrying aids illustrated in FIGS. 1 and 2 with regard to the ends of the recess 66 may permit variation of how and/or where the bearing surface 60 and recess 66 engage a thumb and/or fingers of a grasping hand when a user is using the carrying aid 20. For example, depending on the size and shape of a particular user's hand, a carrying aid similar to the carrying aid 20 of FIG. 1 or to the carrying aid 76 of FIG. 2 may provide a more desirable and/or comfortable fit when a user is using the carrying aid as described herein.

FIGS. 5-7 illustrate several nonexclusive illustrative examples of ways in which a carrying aid may be used. It should be understood that the carrying aids disclosed herein may be held, grasped and/or used in various ways to support various types of containers.

In some examples, the elongate body 22 may be configured to be grasped by a grasping hand to support the container by the bail, as generally shown in FIGS. 5 and 6. For example, the elongate body 22 may be configured to be grasped by a grasping hand 79 to generally suspend the container from a grasping hand in a first position 80, with the bail generally above the container, as suggested in FIG. 6.

The elongate body 22 may be configured to transfer a torque from a grasping hand 79 to the bail 26. In particular, the opposed grip surfaces may be configured to permit a user to selectively apply torque to the bail 26 by applying torque to the elongate body 22. As shown in FIGS. 5 and 6, the first and second opposed grip surfaces may be configured such that the first opposed grip surface 50 engages a thumb 81 of a grasping hand 79 and the second opposed grip surface 52 engages at least one finger, such as a first or forefinger 83, of a grasping hand 79 when a user grasps the elongate body 22 with a grasping hand 79. As generally shown in the example of FIGS. 5 and 6, the first grip surface 50 may be positioned or configured to engage a side of a thumb 81, and the second grip surface 52 may be positioned or configured to engage an extended forefinger 83, such as proximate its tip.

A user may apply torque to the elongate body 22 by using a thumb 81 and a forefinger 83 of a grasping hand 79 to apply opposed pressure to the respective first and second opposed grip surfaces 50, 52 of the elongate body. In particular, as shown in FIGS. 5 and 6, when the elongate body 22 is engaged on the bail 26, the first opposed grip surface 50 is disposed proximate a first part 84 of the bail 26 and the second opposed grip surface 52 is disposed proximate a second part 86 of the bail 26 that is disposed between the first part 84 of the bail 26 and the at least one pivot point 30 on the container 28. When applying torque to the elongate body 22, remaining fingers 87 of a grasping hand 79 may be wrapped around the bearing surface 60 and, if the recess 66 is present, at least partially disposed therein.

The groove 40 may be configured to transfer torque from the elongate body 22 to the bail 26. In particular, when a grasping hand applies torque to the elongate body 22, a first part 90 of the first opposed sidewall 44 of the groove 40 engages the first part 84 of the bail 26 and a second part 92 of the second opposed sidewall 46 of the groove 40 engages the second part 86 of the bail. Thus, as shown in FIGS. 5 and 6, torque applied to the elongate body 22 by a grasping hand 79 may tend to pivot the bail 26 relative to the container 28 and about the axis 31 and the at least one pivot point 30, as suggested by the arrow 93, while lifting the container 28 relative to a grasping hand 79 from the first position 80 to a second position 94 above the first position 80, as suggested by the arrow 95. Accordingly, a user may use a thumb 81 and forefinger 83 of a grasping hand 79 to support the container 28 with the bail 26 displaced to one side, as shown in FIGS. 5 and 6. In examples where the container 28 is a paint can, supporting the container with the bail displaced to one side may enhance brush access to the paint can such as for loading the brush with paint during the painting process.

In the example shown in FIGS. 5 and 6, a thumb 81 is shown engaged with the projection 54, with the rounded exterior portion 56 against the palm of a grasping hand 79. However, the carrying aid may also be used with the elongate body 22 reversed relative to a grasping hand 79 such that the projection 54 is against the palm of a grasping hand 79.

Another nonexclusive illustrative example of a carrying aid for a container is shown generally at 98 in FIG. 7. Unless otherwise specified, the carrying aid 98 may, but is not required to, contain at least one of the structures, components, functionalities, concepts, and/or variations described, illustrated, and/or incorporated herein.

The elongate body 22 of a carrying aid, such as the carrying aid 98, may be configured to be mounted on and extend along the bail 26 to stabilize and support the container 28 relative to a grasping hand 79. For example, as shown in FIG. 7, the elongate body 22 may be configured such that, when at least a portion of the palm of a grasping hand 79 is engaged with the sidewall 62 of the container 28 and the bail 26 is pivoted about the axis 31 such that the bearing surface 60 is proximate the sidewall 62, the bearing surface 60 engages and rests against a thumb 81 of a grasping hand 79. Accordingly, when the container's weight causes the bail 26 to rotate about the axis 31 as the container 28 moves downwardly relative to a grasping hand 79, the bearing surface 60 may urge or press a grasping hand 79 toward or even against the sidewall 62 to stabilize and support the container 28 relative to a grasping hand 79.

In some examples where the elongate body 22 is being used as shown in FIG. 7, the projection 64 on the bearing surface 60 may be configured to engage a thumb 81 of a grasping hand 79. The projection 64 may provide a rest for and/or be pressed on by a thumb 81. In some examples, the projection 64 may be adapted to be gripped between a thumb 81 and forefinger 83 of a grasping hand 79, as shown in FIG. 7. The recess 66 on the bearing surface 60 may be configured to receive and engage a thumb 81 of a grasping hand 79 when at least a portion of the palm of a grasping hand 79 is proximate and/or engaged with the sidewall 62 of the container 28 and the bail 26 is pivoted about the axis 31 such that the bearing surface 60 is proximate the sidewall of the container. In examples where the bearing surface 60 includes a pair of projections 64 that collectively define the ends of the recess 66, as shown in FIG. 7, the one of the projections 64 spaced from the tip of a thumb 81 may bear against the back of a thumb.

The fit of the carrying aid 98 may be adjustable by sliding the elongate body 22 along the bail 26. In particular, in examples where the distance between the bail and the sidewall of the container varies along the length of the bail, as where the container is a one-gallon paint can, moving the elongate body toward or away from one of the pivot points 30 may vary the distance between the bearing surface 60 and the sidewall 62 and/or adjust the size and location of the recess 66.

In some examples, the elongate body 22 may include at least one padded portion 100. For example, at least a part of selected ones of various portions of the exterior surface 38, such as one or more of the first and second opposed grip surfaces 50, 52, the projection 54, the bearing surface 60, the projection 64, the recess 66, and/or the rounded exterior portion 56 may include a padded or resilient material. The selected ones of the various portions of the exterior surface 38 may include those that engage a grasping hand with relatively high forces and/or exert locally high pressures, such as the portions that may engage a thumb 81 proximate its base.

Figure 8:
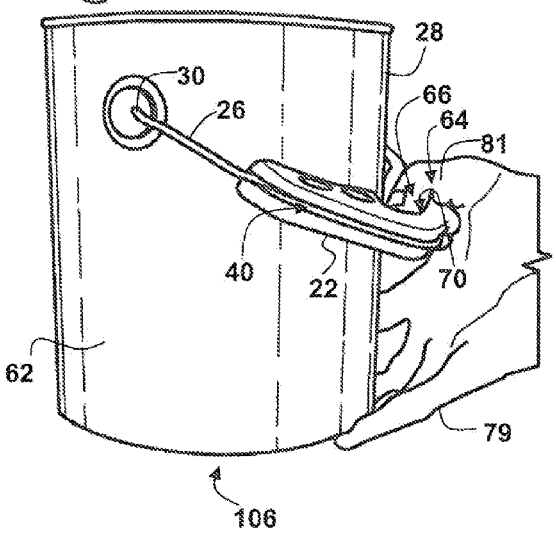
FIG. 8 is a side perspective view of the carrying aid and one-gallon paint can of FIG. 7, being used to support the paint can with an alternate hand position of a right human hand.

Turning now to FIG. 8, elongate body 22 is shown being used to support a paint can. More specifically, a right human hand is shown with a thumb inserted within recess 66, and with fingers grabbing a bottom surface 106 of the paint can. Recess 66 provides a space for the thumb so that bail 26 does not pinch, squish, or press against the thumb. The thumb shown in FIG. 8 uses projection 64 as a rest, while pressing against bearing surface 70 within recess 66.

In some examples, the elongate body 22 may include one or more recesses or indentations 102, as shown in FIGS. 1 and 2. The indentations 102 may enhance a user's grip of the elongate body 22, provide an indication that a grasping hand is properly positioned on the elongate body, and/or provide a more comfortable grip for a grasping hand.

Figure 9:
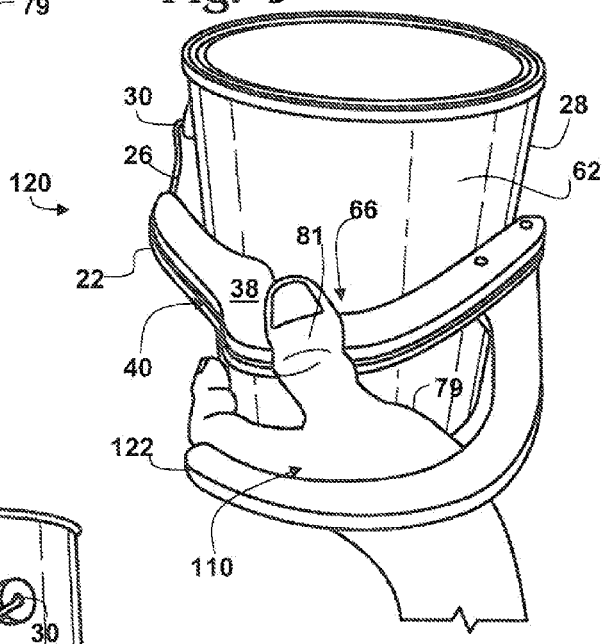
FIGS. 9 and 10 show different views of another nonexclusive illustrative example of a carrying aid, with an auxiliary leverage brace being used to support a paint can.
Figure 10:
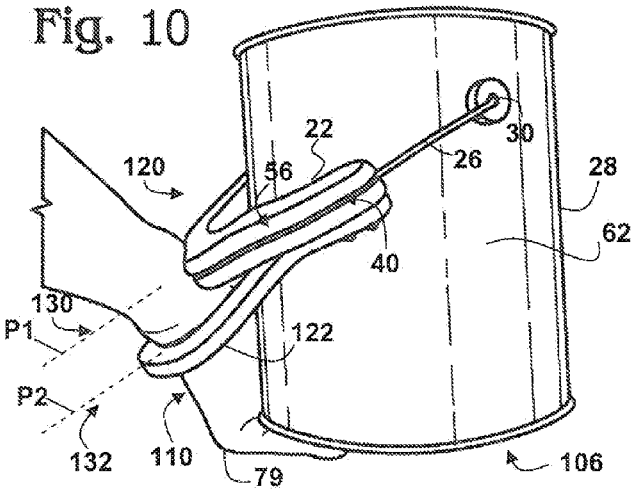

Turning now to FIGS. 9 and 10, another nonexclusive illustrative example of a carrying aid for a container is shown generally at 120. Carrying aid 120 includes an elongate body 22, and further includes an auxiliary leverage brace 122. In this example, leverage brace 122 terminates proximate rounded exterior portion 56 generally in the shape of a hook.

Leverage brace 122 may be disposed on elongate body 22 and may be generally displaced toward one end of elongate body 22, protruding away from axis 31 and extending over rounded exterior portion 56. Leverage brace 122 is configured to selectively engage various items, such as at least a portion of a back part or dorsal surface 110 of a gripping hand, as shown in FIG. 9, or at least a portion of a forearm, as shown in FIG. 10. Leverage brace 122 also functions as a hook, allowing easy suspension of a paint can from many convenient surfaces (not shown), such as a side or rung of a ladder, a gutter, or a door knob.

Comparing FIG. 9 to FIG. 11, it will be seen that the orientation of leverage brace 122 relative to a paint can may be reversed, either by simply flipping the bail from one side of the can to another, or by physically removing carrying aid 120 from the bail, flipping the relative orientation of carrying aid 120 relative to the bail, and remounting carrying aid 120 on the bail. Different orientations of carrying aid 120 relative to a paint can allow leverage brace 122 to engage different parts of a hand or body, and can help reduce forces and relieve strain on fingers holding a paint can. FIG. 12 provides a different perspective on the hand position shown in FIG. 11.

An added detail to the examples of FIGS. 9-14 is best understood with reference to a first plane 130 defined by elongate body 22, and a second plane 132 defined by leverage brace 122. Preferably, the second plane 132 is laterally displaced from the first plane 130, as represented by dashed lines P1 and P2 in FIGS. 10 and 13. The planar displacement of elongate body 22 relative to leverage brace 122 is such that a hand may apply different torques to a bail when grasping carrying aid 120 from different directions. For example, in FIG. 10, leverage brace 122 is shown being engaged by a portion of a dorsal surface 110 of a left human hand 79 proximate below a wrist, while in FIG. 13, leverage brace 122 is shown being engaged by a portion of a forearm above a wrist of a left human hand 79. By flipping the bail to an opposite side of the can, leverage brace 122 is moved easily to an alternate orientation, allowing a user to select from two differently leveraged engagements above and below a wrist of a grasping hand 79, and quickly providing variety to help avoid fatigue.

Similarly, in FIG. 9, leverage brace 122 is shown being engaged by a portion of a dorsal surface 110 of a hand close to a wrist of a human arm, while in FIG. 12, leverage brace 122 is shown being spaced farther away, so that there is little or no contact between a wrist and leverage brace 122, when held as shown. Thus, by flipping the bail from the position shown in of FIG. 9 to an opposite side of the can as shown in FIG. 12, a relative position of leverage brace 122 and a paint can is adjusted easily.

Because the leverage brace is offset from the main body the hook optionally engages lower on the back of the hand in one position, flip the bail/body to the other side of the can and the hook engages higher, more towards the wrist, the higher position offers more leverage on the can bail to prevent tipping.

Turning now to FIG. 14, yet another hand position is shown. A hand is inserted between elongate body 22 and leverage brace 122. A thumb is shown pressing on a base 124 of leverage brace 122.

Figure 15:
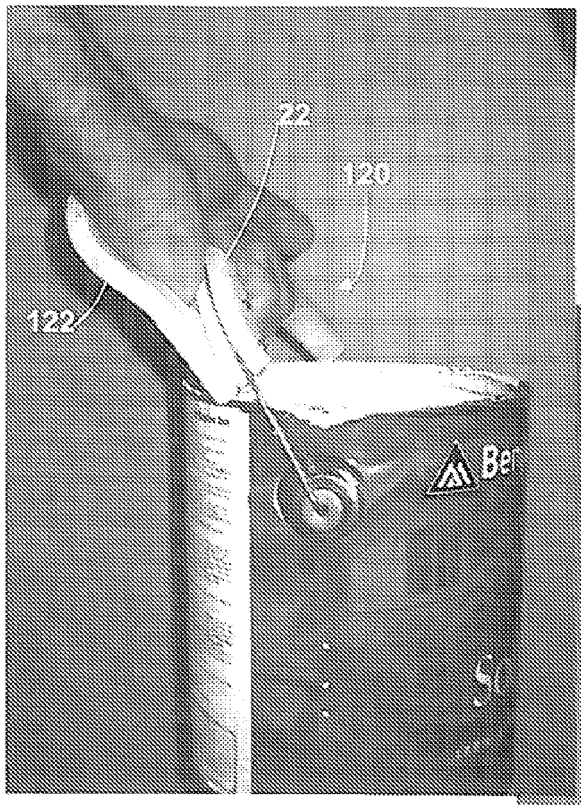
FIG. 15 is a side perspective view of the carrying aid of FIG. 14, with a back of a hand hooked through the auxiliary leverage brace to move the bail to one side for easier access to paint in a can.
Figure 16:
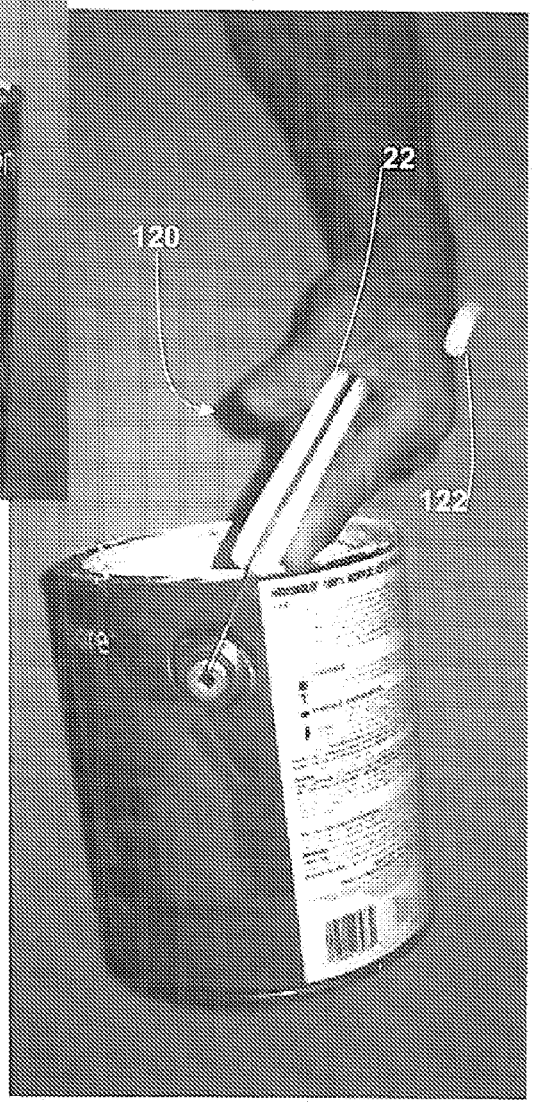
FIG. 16 is a side perspective view of the carrying aid of FIG. 15, viewed from a different location relative to the can.

FIGS. 15 and 16 show yet more hand positions. A hand is inserted between elongate body 22 and leverage brace 122, and the paint can is allowed to hang freely. In this hanging use position, a user may easily leverage or torque the bail to one side of the can for easy access to paint in the can, by engaging the opposing leverage surfaces defined by body 22 and leverage brace 122. Several of such hanging positions require little if any pressure from a thumb or forefinger. In this hanging position a palmer side of a hand that engages body 22 to apply one force and a back of a hand engages lever brace 122 to apply a second force to create torque to pivot the bail.

Figure 17:
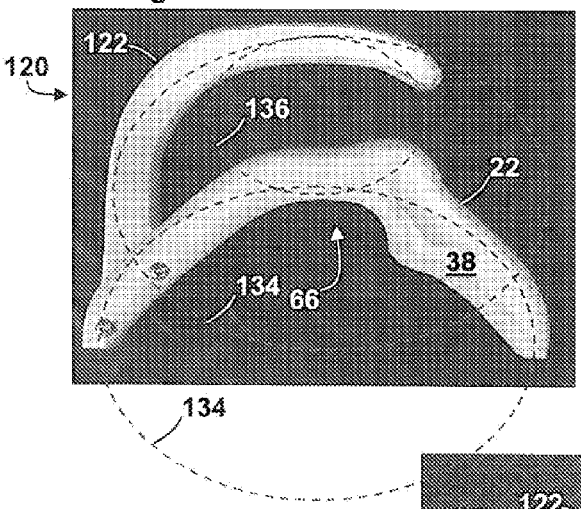
FIG. 17 is a plan view of the illustrative example of a carrying aid with a leverage brace of FIGS. 9-16.

Relative proportions of elongate body 22 to leverage brace 122 are seen best in FIG. 17. For example, a first ellipse 134 defines approximately a curvature of elongate body 22, and the same ellipse 134 defines approximately a curvature of leverage brace 122. Furthermore, a second ellipse 136 approximately one-half the size of first ellipse 134 defines approximately a distance between a central portion of leverage brace 122 and elongate body 22.

Figure 18:
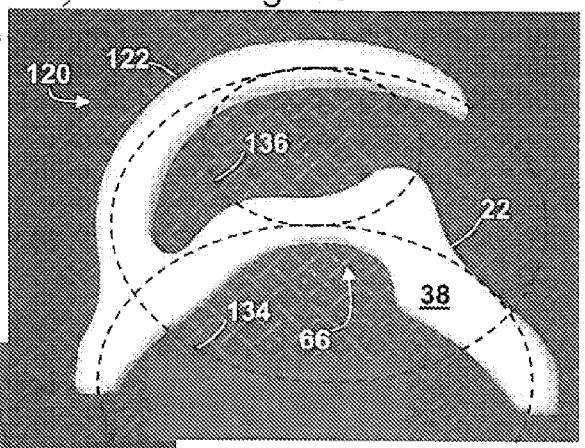
FIG. 18 is a plan view of another illustrative example of a carrying aid with a leverage brace.

Similar relative proportions are shown in FIG. 18. However, the example carrying aid 120 shown in FIG. 18 is planar, without any offset between a plane defined by elongate body 22, and a plane defined by leverage brace 122.

Figure 19:
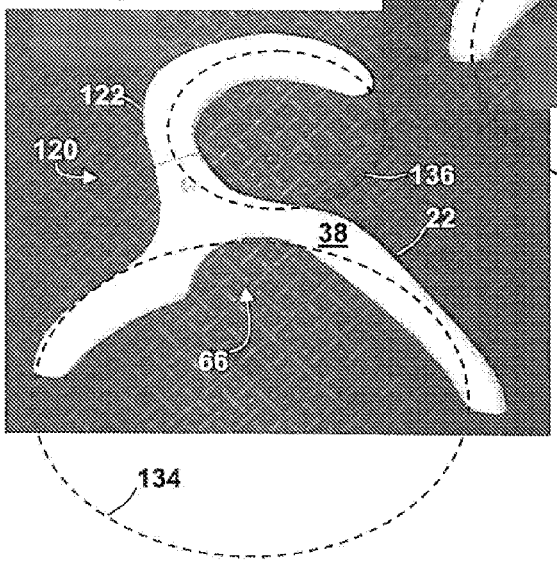
FIG. 19 is a plan view of yet another illustrative example of a carrying aid with a leverage brace.

Very different proportions are shown in FIG. 19. The example carrying aid 120 shown in FIG. 19 is planar, without any offset between a plane defined by elongate body 22, and a plane defined by leverage brace 122. As shown, a first ellipse 134 defines approximately a curvature of elongate body 22. A second ellipse 136 that defines approximately a curvature of leverage brace 122, is approximately one-half the size of first ellipse 134. Second ellipse 136 also defines approximately a distance between a central portion of leverage brace 122 and elongate body 22.

The following paragraphs outline and/or describe nonexclusive illustrative examples of methods for supporting a container and/or painting using a carrying aid and the concepts discussed above. Although the steps of the following methods may be performed in the order in which they are presented below, it is within the scope of this disclosure for the following steps, either alone or in various combinations, to be performed before and/or after any of the other following steps.

A method for painting may include mounting a carrying aid on the bail of a paint can, which may be a one-gallon paint can. The paint can may be supported by a grasping hand in a conventional position, in which the paint can is suspended from the bail. A user may apply a torque to the carrying aid using a thumb and forefinger and or if a leverage brace is present the hand part to which the leverage brace engages of a grasping hand, with the carrying aid transmitting the torque to the bail to pivot the bail such that the bail is displaced to one side while a user is supporting the paint can with a grasping hand. A paint brush may be dipped into the paint can when the bail is displaced to one side. In some examples, a user may release the torque applied to the carrying aid such that the bail and paint can return to the conventional position. In some examples, the method may be repeated.

A method for painting may include mounting a carrying aid on the bail of a paint can, which may be a one-gallon paint can. The bail may be pivoted down proximate the sidewall of the paint can. A user may then press a grasping hand against the sidewall, with at least a portion of a grasping hand, such as a thumb, extending between the carrying aid and the sidewall of the paint can. The carrying aid may engage a thumb of a grasping hand and press a grasping hand against the sidewall to stabilize and support the paint can relative to a grasping hand. A paint brush may be dipped into the paint can when the paint can is stabilized and supported relative to a grasping hand.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A carrying aid for use with a container having a curved wire bail pivotably attached to at least one pivot point on the container, the carrying aid comprising:

an elongate body configured to engage the bail and be grasped by a grasping hand to suspend the container from a grasping hand in a first position, wherein;

the elongate body is configured to transfer a torque from a grasping hand to the bail, with the torque tending to pivot the bail about the at least one pivot point while lifting the container relative to a grasping hand from the first position to a second position above the first position;

the elongate body includes a first and a second opposed grip surfaces, the first grip surface being configured to engage a thumb of the grasping hand, and the second grip surface being configured to engage a finger of the grasping hand, so that opposed pressure applied to the first and second opposed grip surfaces by the thumb and finger of the grasping hand applies the torque to the elongate body; and the elongate body includes a projection that extends away from the at least one pivot point when the elongate body is engaged with the bail, the first grip surface is disposed on the projection, and the elongate body includes a rounded exterior portion configured to engage the palm of a grasping hand.

2. The carrying aid of claim 1, wherein the elongate body includes a groove configured to receive and engage the bail to transfer torque from the elongate body to the bail.

3. The carrying aid of claim 2, wherein the elongate body has an exterior surface and the groove includes a base surface and first and second opposed sidewalls that extend from the base surface of the groove to the exterior surface of the elongate body, and upon application of the torque to the elongate body by the grasping hand a first part of the first opposed sidewall engages a first part of the bail and a second part of the second opposed sidewall engages a second part of the bail that is disposed between the first part of the bail and the at least one pivot point on the container.

4. The carrying aid of claim 3, wherein the first and second opposed sidewalls of the groove are substantially flat and the base surface of the groove is curved to engage the bail.

5. The carrying aid of claim 1, wherein, when the elongate body is engaged on the bail, the first grip surface is disposed proximate a first part of the bail and the second grip surface is disposed proximate a second part of the bail that is disposed between the first part of the bail and the at least one pivot point on the container.

6. The carrying aid of claim 1, wherein the first grip surface is configured to engage a side of the thumb, and the second grip surface is configured to engage the finger proximate its tip, with the finger extended.

7. The carrying aid of claim 1, wherein the container is a one-gallon paint can.

8. The carrying aid of claim 7, wherein the elongate body includes at least one holder configured to engage and retain a paint brush.

9. The carrying aid of claim 1, wherein the elongate body includes at least one padded portion.

10. The carrying aid of claim 1, wherein the container includes a sidewall, the elongate body includes a curved grasping surface configured to permit the bail to be pivoted down proximate the sidewall of the container, and the curved grasping surface is configured to engage the thumb of the grasping hand and press the grasping hand against the sidewall to stabilize and support the container relative to the grasping hand.

11. The carrying aid of claim 1, wherein the elongate body includes a leverage brace disposed on and extending from the elongate body.

12. The carrying aid of claim 11, wherein the grasping hand has a palmar surface and a dorsal surface, and the leverage brace engages at least a portion of the dorsal surface of the grasping hand.

13. A carrying aid for use with a container having a sidewall and a curved wire bail pivotably attached to the container for rotation of the wire bail about an axis, the carrying aid comprising:

an elongate body configured to be mounted on and extend along the bail to stabilize and support the container relative to a grasping hand, wherein the elongate body includes a bearing surface configured to engage and rest against a thumb of a grasping hand when at least a portion of the palm of a grasping hand is engaged with the sidewall of the container and the bail is pivoted about the axis such that the bearing surface is proximate the sidewall of the container, the bearing surface includes a projection that extends toward the axis when the elongate body is mounted on the bail, the projection is configured to engage a thumb of a grasping hand, and the bearing surface is configured to urge a grasping hand against the sidewall of the container when the container's weight causes the bail to rotate about the axis.

14. The carrying aid of claim 13, wherein the bearing surface includes a recess configured to receive and engage a thumb of a grasping hand when the at least a portion of the palm of a grasping hand is engaged with the sidewall of the container and the bail is pivoted about the axis such that the bearing surface is proximate the sidewall of the container.

15. The carrying aid of claim 14, wherein the projection defines an end of the recess.

16. The carrying aid of claim 15, wherein the projection is adapted to be gripped between a thumb and first finger of a grasping hand.

17. The carrying aid of claim 16, wherein the container is a one-gallon paint can.

18. The carrying aid of claim 14, wherein contact between the projection and the sidewall establishes a pivotable end point of the bail about the axis, and a portion of the bearing surface within the recess is spaced from the sidewall when the bail is at the pivotable end point.

19. The carrying aid of claim 13, wherein the elongate body includes a groove configured to receive and engage the bail.

20. The carrying aid of claim 13, wherein the elongate body includes first and second opposed grip surfaces, the elongate body is configured to engage the bail and be grasped by a grasping hand to suspend the container from a grasping hand in a first position, the first grip surface is configured to engage a thumb of a grasping hand, the second grip surface is configured to engage a finger of a grasping hand, and opposed pressure applied to the first and second opposed grip surfaces by a thumb and finger of a grasping hand applies a torque to the elongate body, with the torque tending to pivot the bail relative to the container and about the axis while lifting the container relative to a grasping hand from the first position to a second position above the first position.

21. A paint can holder, comprising:

a body configured to be mounted on a bail of a one-gallon paint can and grasped by a grasping hand to support the paint can by the bail, the bail being pivotably attached to at least one pivot point on the can, wherein the elongate body includes opposed leverage surfaces configured to engage a thumb and forefinger of a grasping hand that grasps the elongate body, with the opposed leverage surfaces being configured to permit a grasping hand to selectively apply a torque to and pivot the bail using a thumb and forefinger of a grasping hand such that the bail is displaced to one side of the one-gallon paint can; and the elongate body includes a projection that extends away from the at least one pivot point when the elongate body is engaged with the bail, the first grip surface is disposed on the projection, and the elongate body includes a rounded exterior portion configured to engage the palm of a grasping hand.

22. The paint can holder of claim 21, wherein the paint can includes a sidewall, the elongate body includes a curved grasping surface configured to permit the bail to be pivoted down proximate the sidewall of the paint can with the body mounted on the bail, and the curved grasping surface is configured to engage a thumb of a grasping hand and press a grasping hand against the sidewall to stabilize and support the paint can relative to the grasping hand.

23. The paint can holder of claim 21, wherein the elongate body includes a grasping arm configured to engage a grasping hand at a palmar surface, and a leverage brace configured to engage a grasping hand at a dorsal surface while the palmar surface is turned upwards, thereby permitting a user to cause a torque to be applied to the elongate body which displaces the bail to one side of the paint can.

24. The paint can holder of claim 23, wherein the leverage brace is configured to extend beyond the sweep of the pivotable bail.

25. The paint can holder of claim 24, wherein the grasping arm defines a first plane and is configured to be grasped by either of a hands from either direction, and the leverage brace defines a second plane laterally displaced from the first plane, such that a hand applies different torques to the bail when grasping the elongate body from different directions.

26. The paint can holder of claim 24, wherein the leverage brace is mounted at one end to the grasping arm to form an open-sided hook.

27. A method of painting, comprising:

mounting a carrying aid on a bail of a paint can containing paint;

where the carrying aid includes an elongate body configured to engage the bail and be grasped by a grasping hand to suspend the paint can from a grasping hand in a first position, wherein;

the elongate body is configured to transfer a torque from a grasping hand to the bail, with the torque tending to pivot the bail about the at least one pivot point while lifting the container relative to a grasping hand from the first position to a second position above the first position;

the elongate body includes a first and a second opposed grip surfaces, the first grip surface being configured to engage a thumb of the grasping hand, and the second grip surface being configured to engage a finger of the grasping hand, so that opposed pressure applied to the first and second opposed grip surfaces by the thumb and finger of the grasping hand applies the torque to the elongate body; and the elongate body includes a projection that extends away from the at least one pivot point when the elongate body is engaged with the bail, the first grip surface is disposed on the projection, and the elongate body includes a rounded exterior portion configured to engage the palm of a grasping hand;

supporting the paint can by grasping the mounted carrying aid using a hand, so that the paint can is suspended from the bail;

applying a torque to the carrying aid using the grasping hand, so that the bail is displaced to one side; and dipping a paint brush into the paint while the bail is displaced to one side.

28. A method for painting, comprising:

mounting a carrying aid on a bail of a paint can;

where the carrying aid includes an elongate body configured to engage the bail and be grasped by a grasping hand to suspend the paint can from a grasping hand in a first position, wherein;

the elongate body is configured to transfer a torque from a grasping hand to the bail, with the torque tending to pivot the bail about the at least one pivot point while lifting the container relative to a grasping hand from the first position to a second position above the first position;

the elongate body includes a first and a second opposed grip surfaces, the first grip surface being configured to engage a thumb of the grasping hand, and the second grip surface being configured to engage a finger of the grasping hand, so that opposed pressure applied to the first and second opposed grip surfaces by the thumb and finger of the grasping hand applies the torque to the elongate body; and the elongate body includes a projection that extends away from the at least one pivot point when the elongate body is engaged with the bail, the first grip surface is disposed on the projection, and the elongate body includes a rounded exterior portion configured to engage the palm of a grasping hand;

pivoting the bail downward until it is proximate a side wall of the paint can;

pressing a grasping hand against the sidewall so that at least a portion of the grasping hand extends between the carrying aid and the sidewall of the paint can; and dipping a paint brush into the paint can while the paint can is stabilized and supported with respect to the grasping hand.

29. The method of claim 28, wherein the portion of the grasping hand extending between the carrying aid and the sidewall of the paint can is a thumb of the grasping hand.

* * * * *